US005647822A

United States Patent [19]

Avganim

[11] Patent Number: 5,647,822

[45] Date of Patent: Jul. 15, 1997

[54] BICYCLE-TYPE EXERCISING DEVICE

[76] Inventor: Meir Avganim, 156 Moshav, Gealiya, Israel

[21] Appl. No.: 521,054

[22] Filed: Aug. 29, 1995

[30] Foreign Application Priority Data

Sep. 2, 1994 [IL] Israel ..... 110843

[51] Int. Cl.[6] ..... A63B 21/22

[52] U.S. Cl. ..... 482/60; 482/57

[58] Field of Search ..... 482/60, 57, 58, 482/59, 61, 62, 63

[56] References Cited

U.S. PATENT DOCUMENTS 3,056,603 10/1962 Levine et al. ..... 482/57

4,262,902 4/1981 Dranselka ..... 482/60

4,787,626 11/1988 Gallagher ..... 482/904

4,838,547 6/1989 Sterling ..... 482/57

*Primary Examiner*—Stephen R. Crow

*Attorney, Agent, or Firm*—Ostrolenk, Faber, Gerb & Soffen, LLP

[57] ABSTRACT

A kit-form bicycle-type exercising device which is operable to exercise the feet and the hand muscles of the user. The device comprises friction resistance pedals mechanism, supported on front and rear elongated bars. First releasable fastening structure attaches the bars to a first base plate, and second releasable fastening structure attaches the first base plate to a second plate. When in use, both plates lie in the same plane.

4 Claims, 4 Drawing Sheets

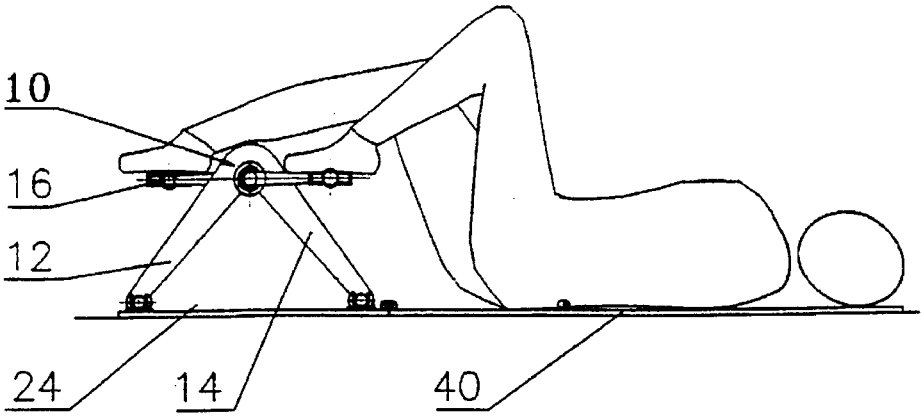
FIG. 7
FIG. 8
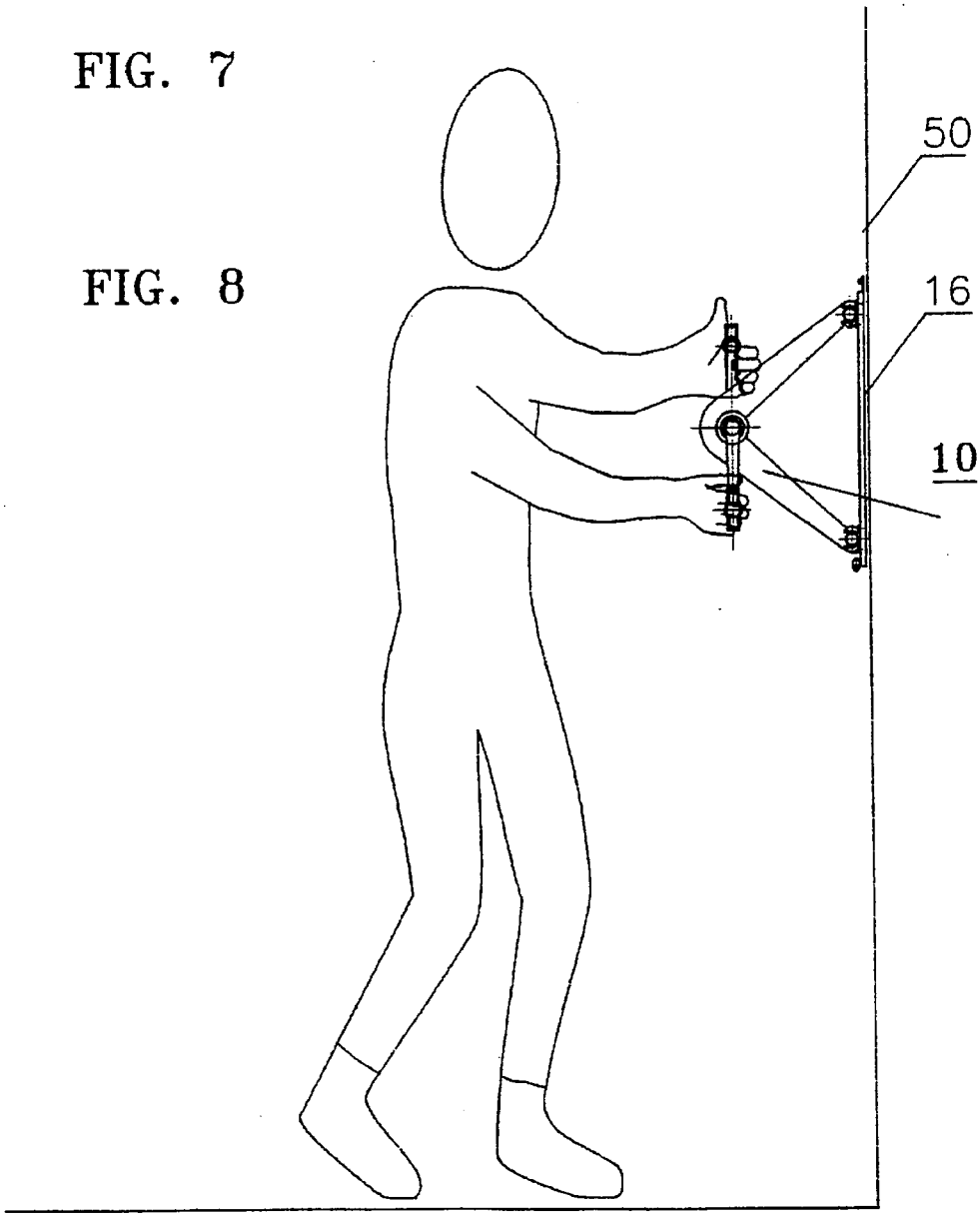

BICYCLE-TYPE EXERCISING DEVICE

BACKGROUND OF THE INVENTION

The present invention relates to exercising devices and particularly to bicycle-type exercises for training the feet muscles of the user.

Bicycle-type exercising devices are known in numerous forms and models. For example in U.S. Pat. No. 4,390,177 (Biran) there has been disclosed a feet operated exercising device essentially comprising a frame carrying a pedal friction resistance mechanism and a pair of pivotable arms of adjustable length, for anchoring the device to the front legs of a chair on which the user is seated.

These devices have been experienced to be quit complicated, costly and not readily foldable into a neat package. Furthermore, the connecting arms are of such construction that only legged seats could be used and not, for example, armchairs, sofas or other siting furniture pieces not supported by at least two front, relatively thin, spaced legs.

It is thus the general object of the invention to provide a bicycle-type exercising device which can readily be installed in its operative position without resort to a specific structure of a sitting furniture.

It is a further object of the invention to allow the device to be used even without any additional furniture, e.g. by person lying on the floor or a bed.

It is a still further object of the invention to allow the device to be operated when in a vertical position, e.g. hanging on a wall, for exercising the hands of the user.

SUMMARY OF THE INVENTION

There is thus provided a bicycle-type exercising device comprising a friction resistance pedals mechanism supported on front and rear elongated bars. Releasable fastening means are provided for attaching the bars to a base plate, on the one hand, and for attaching the base plate to a second plate—on the other hand, both plates lying in the same plane.

BRIEF DESCRIPTION OF THE DRAWINGS

These and further constructional features and advantages of the invention will be more clearly understood in the light of the ensuing description of preferred embodiments of the invention, given by way of example only, with reference to the accompanying drawings wherein

FIG. 7 illustrates the use of the device in a lying position; and

FIG. 8 illustrates the use of the device in a standing position.

DETAILED DESCRIPTION OF THE PREFERRED EMBODIMENTS

Figure 1:
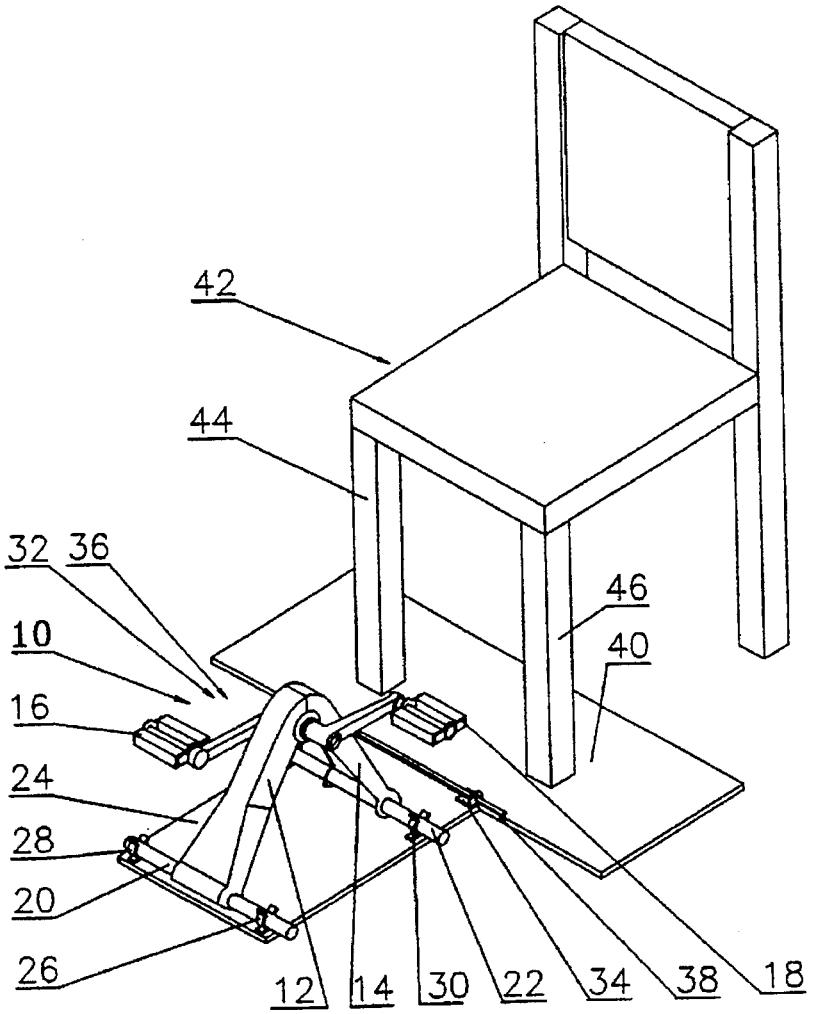
FIG. 1 is a three-dimensional view of the device used in association with a chair.

Referring now to FIG. 1 there is shown the exercising device generally denoted 10 which comprises a pair of frame members 12 and 14, a pair of pedals 16 and 18 and frame members support rods 20 and 22. The rods 20 and 22 are releasably coupled to a first base plate 24, e.g. by springy clips 26, 28, 30 and 32.

The plate 24 is releasably coupled, such as by matching pairs of eyelets generally designated 34 and 36 and hinge rod 38, to a second plate 40. The plate 40 may be of various sizes and shapes, as may be required for different applications (see below).

A chair 42 is, seen having its front legs 44 and 46 standing on the plate 40.

Figure 2:
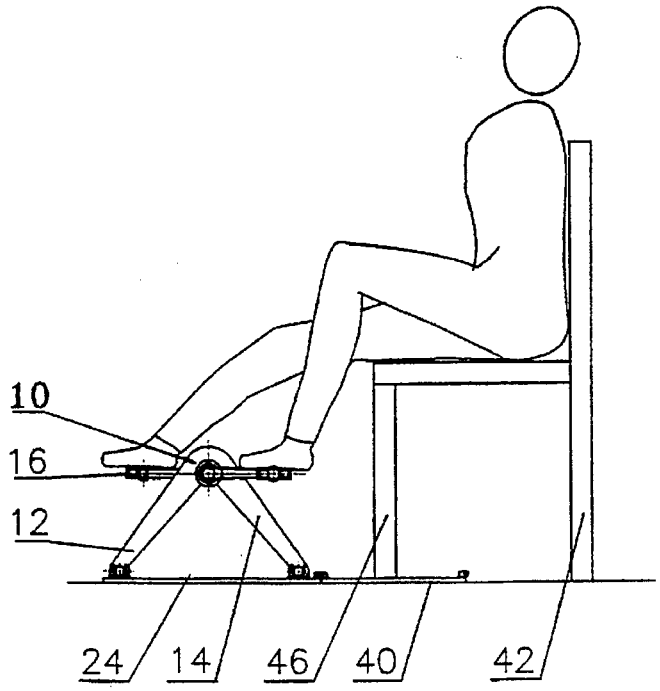
FIG. 2 illustrates the use of the device of FIG. 1.

The use of the device is clearly illustrated in FIG. 2 and need not be further elaborated upon.

Figure 3:
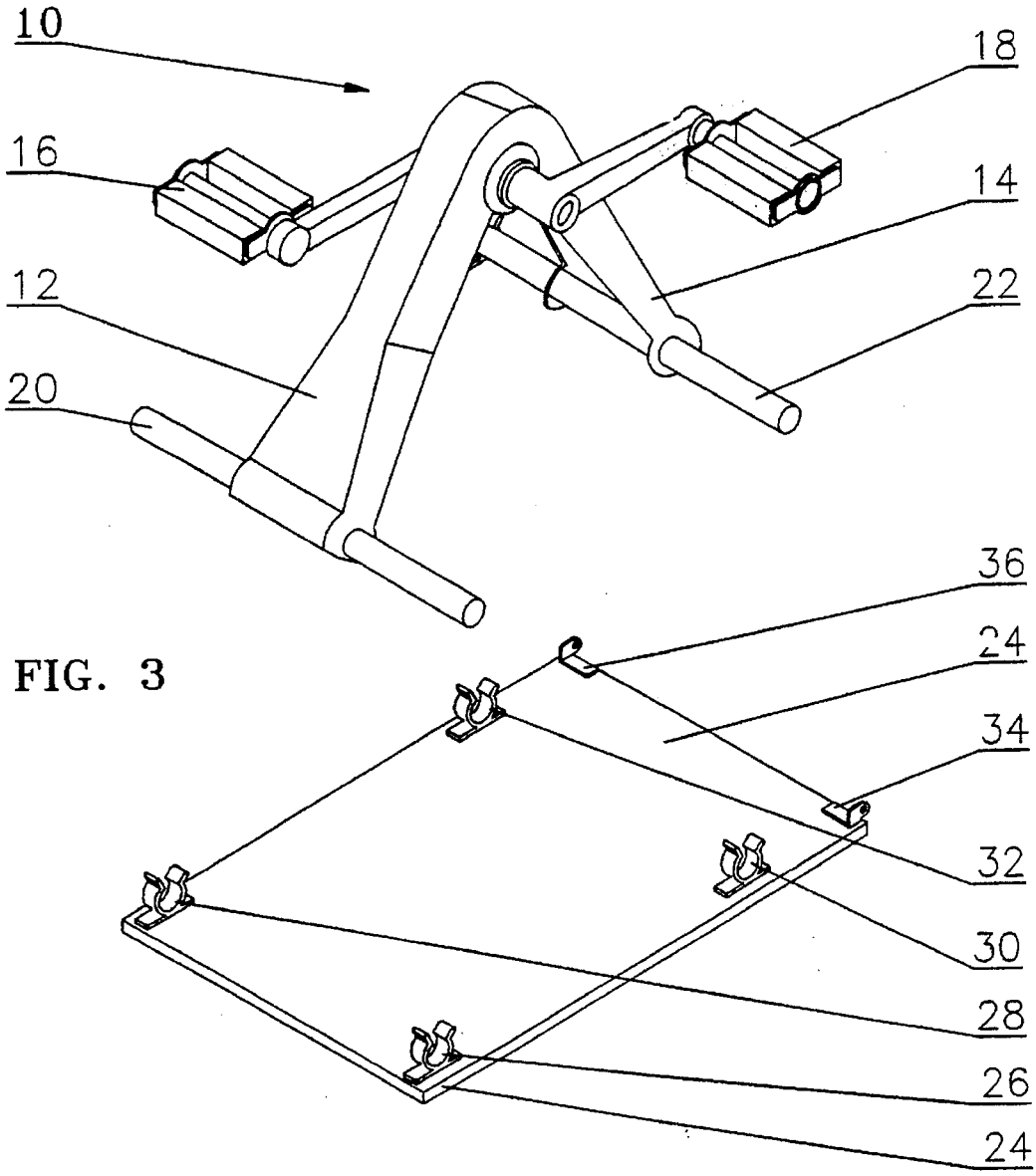
FIG. 3 illustrates the disassembly of the exercising device from its support plate.
Figure 4:
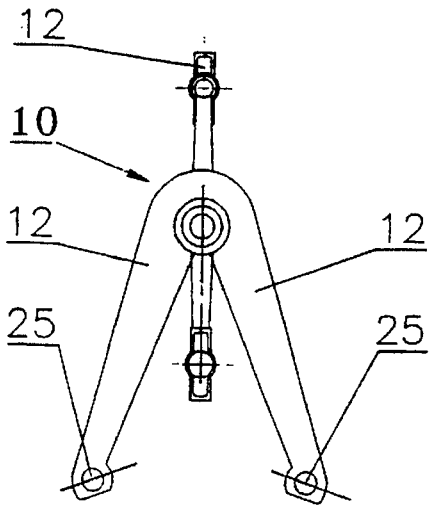
FIG. 4 is a side view of the exercising device in its folded position.
Figure 5:
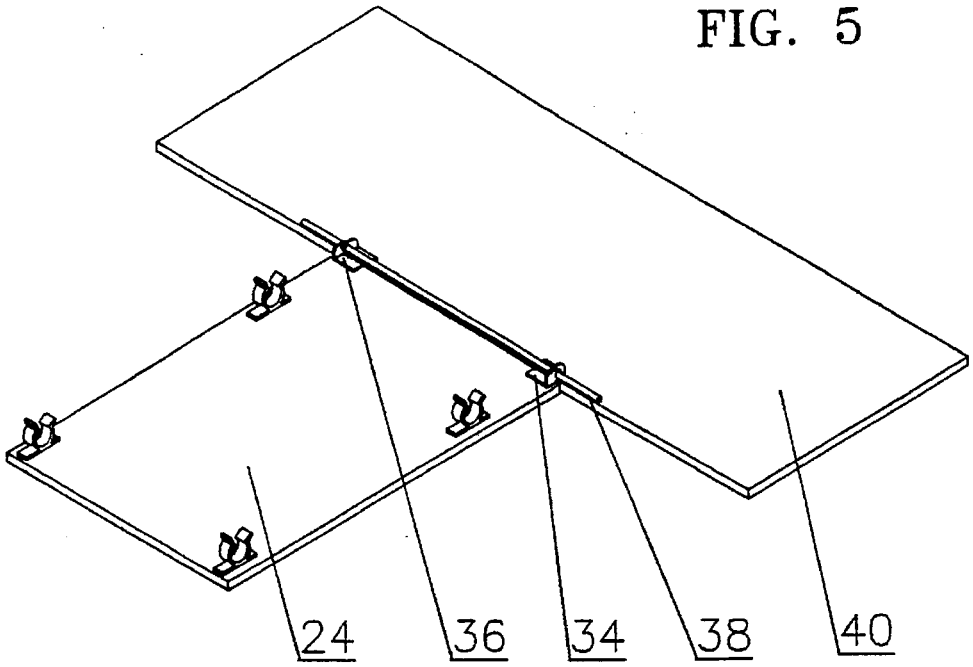
FIG. 5 shows the pair of plates supporting the device of FIG. 1.
Figure 6:
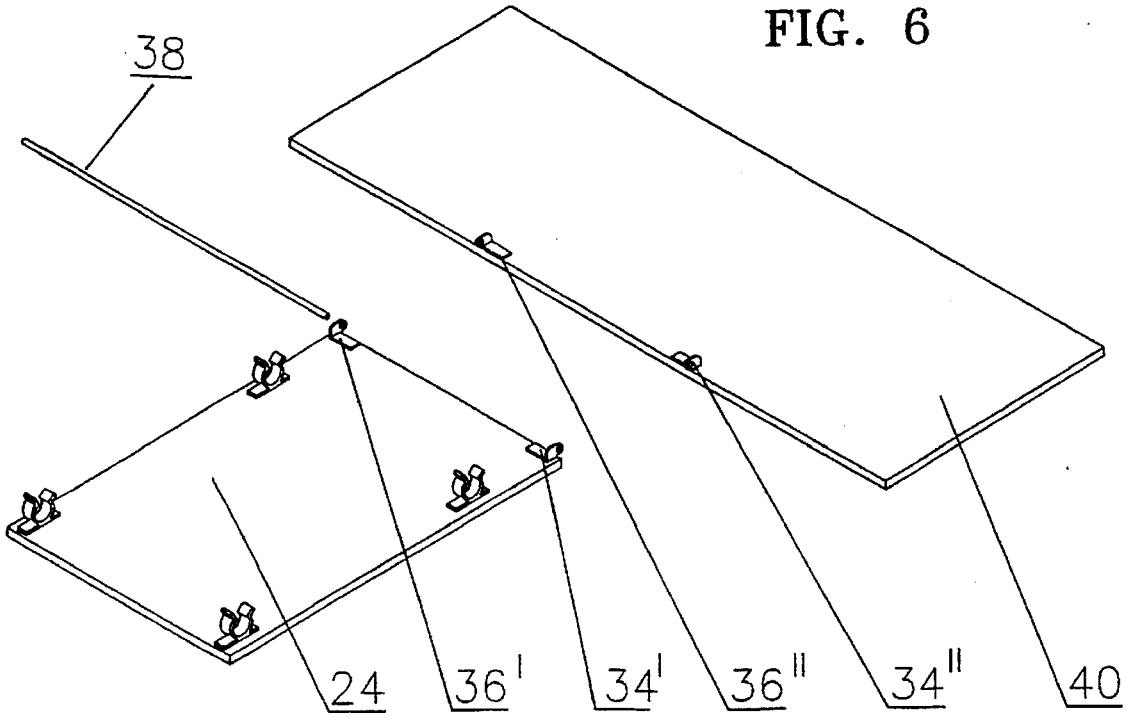
FIG. 6 illustrates the disassembly of the support plates.

The disassembling and folding the device into its knocked-down or kit state, whereby it can be easily carried in a bag or suitcase, is clearly shown in FIGS. 3–6. Hence, the first stage is to release the device 10 from the plate 24, namely from the springy clips 26–30 as seen in FIG. 3. Then, the pedal device 10 is folded together to the form seen in FIG. 4. The pair of plates 24 and 40 are disconnected from each other by pulling out the hinge rod 38 from the eyelets 34', 34" and 36', 36" as seen in FIG. 6. The components thus can be easily packed and carried to trips, etc.

It will be now readily understood that the unique improvement of the device according to the invention relative to previously known devices, resides in that it is self-contained and its use being independent in as much as auxiliary supporting objects are concerned. The supporting furniture piece can be of any type, with or without legs. This feature is vividly exemplified in the illustration of the use of the device in a lying position—see FIG. 7—or in a standing position for exercising the hands as illustrated in FIG. 8 where the device 10 is hanged on a wall 50 by any suitable means.

Thus established is an improved kit-form bicycle-type exercising device which is extremely low-cost, and of simple and convenient installation and/or storage procedure—as the case may be.

Those skilled in the art will readily understand that various changes, modification and variations of the device may be applied without departing from the scope of the invention as defined in and by the appended claims.

What is claimed is:

1. A kit-form bicycle-type exercising device comprising a friction resistance pedals mechanism supported on front and rear elongated bars, first releasable fastening means for attaching the bars to a first base plate, and second releasable fastening means for attaching the first base plate to a second plate, both plates lying in the same plane.

2. The device as claimed in claim 1 wherein the said first fastening means comprise springy clamps.

3. The device as claimed in claim 2 wherein the said second fastening means comprise a retrievable hinge rod.

4. The device as claimed in claim 1 wherein the pedal mechanism is foldable.

* * * * *